US006116050A

United States Patent [19]

Yao et al.

[11] Patent Number: 6,116,050

[45] Date of Patent: Sep. 12, 2000

[54] PROPANE RECOVERY METHODS

[75] Inventors: Jame Yao; Jong Juh Chen; Rong-Jwyn Lee, all of Sugar Land; Douglas G. Elliot, Houston, all of Tex.

[73] Assignee: IPSI LLC, Houston, Tex.

[21] Appl. No.: 09/209,931

[22] Filed: Dec. 4, 1998

[51] Int. Cl.[7] ..... F25J 3/00

[52] U.S. Cl. ..... 62/630; 62/631

[58] Field of Search ..... 62/630, 631, 620

[56] References Cited

U.S. PATENT DOCUMENTS

| | | | |
|---|---|---|---|
| 3,592,015 | 7/1971 | Streich et al. | 62/24 |
| 4,171,964 | 10/1979 | Campbell et al. | 62/24 |
| 4,251,249 | 2/1981 | Gulsby | 62/28 |
| 4,278,457 | 7/1981 | Campbell et al. | 62/24 |
| 4,318,723 | 3/1982 | Holmes et al. | 62/20 |
| 4,350,511 | 9/1982 | Holmes et al. | 62/17 |
| 4,371,381 | 2/1983 | Schuftan | 62/630 |
| 4,596,588 | 6/1986 | Cook | 62/631 |
| 4,617,038 | 10/1986 | Mehra | 62/17 |
| 4,680,042 | 7/1987 | Mehra | 62/17 |
| 4,687,499 | 8/1987 | Aghili | 62/24 |
| 4,690,702 | 9/1987 | Paradowski et al. | 62/631 |
| 4,692,179 | 9/1987 | Mehra | 62/17 |
| 4,698,081 | 10/1987 | Aghili | 62/24 |
| 4,851,020 | 7/1989 | Montgomery, IV | 62/24 |
| 4,885,063 | 12/1989 | Andre | 203/73 |
| 5,152,148 | 10/1992 | Crum et al. | 62/631 |
| 5,275,005 | 1/1994 | Campbell et al. | 62/24 |
| 5,421,165 | 6/1995 | Paradowski et al. | 62/24 |
| 5,566,554 | 10/1996 | Vijayaraghavan et al. | 62/621 |
| 5,588,306 | 12/1996 | Schmidt | 62/614 |
| 5,600,969 | 2/1997 | Low | 62/622 |

*Primary Examiner*—William Doerrler
*Attorney, Agent, or Firm*—Shook, Hardy & Bacon LLP

[57] ABSTRACT

The present invention is directed to methods for separating and recovering propane, propylene and heavier hydrocarbons, i.e., the $C_3$+ hydrocarbons, from a gas feed, e.g., raw natural gas or a refinery or petroleum plant gas stream. These methods employ sequentially configured first and second distillation columns, e.g., a de-methanizer tower followed by a de-ethanizer tower. A cooled gas feed condensate is separated in the first column into methane and a liquid phase comprising ethane and heavier hydrocarbons. The liquid phase is separated in the second column into a gas phase primarily comprising ethane and a second liquid phase primarily comprising the desired $C_{3+}$ hydrocarbons. At least a portion of the second gas phase is introduced into the first distillation column as an overhead reflux to improve the separation of $C_{3+}$ hydrocarbons. The methods of the present invention permit separation and recovery of more than about 99% of the $C_{3+}$ hydrocarbons in the gas feed at higher operating pressures. Further, by cooling the second gas phase with a liquid condensed in a lower tray of the first column, significant capital and operating costs may be saved. By using the self refrigeration system, the need for external refrigeration is eliminated and the separation efficiency is improved in the first column. Accordingly, the processes of the present invention result in achieving higher liquid recovery levels with lower capital requirements and significant savings in operation.

47 Claims, 5 Drawing Sheets

PROPANE RECOVERY METHODS

BACKGROUND OF THE INVENTION

1. Field of the Invention

The present invention is directed toward methods for separating hydrocarbon gas constituents to more efficiently and economically separate and recover both the light, gaseous hydrocarbons and the heavier hydrocarbon liquids. The present invention provides methods for achieving essentially complete separation and recovery of propane and heavier hydrocarbon liquids. More particularly, the methods of the present invention more efficiently and more economically separate propane, propylene and heavier hydrocarbon liquids (and, if desired, ethane and ethylene) from any hydrocarbon gas stream, i.e., from natural gas or from gases from refinery or petroleum plants.

2. Description of the Background

In addition to methane, natural gas includes some heavier hydrocarbons and other impurities, e.g., carbon dioxide, nitrogen, helium, water and non-hydrocarbon acid gases. After compression and separation of these impurities, natural gas is further processed to separate and recover natural gas liquids (NGL). In fact, natural gas may include up to about fifty percent (50%) by volume of heavier hydrocarbons recovered as NGL. These heavier hydrocarbons must be separated from the methane to provide pipeline quality methane and recovered natural gas liquids. These valuable natural gas liquids comprise ethane, propane, butane and other heavier hydrocarbons. In addition to these NGL components, other gases, including hydrogen, ethylene and propylene, may be contained in gas streams from refinery or petrochemical plants.

Processes for separating hydrocarbon gas components are well known in the art. C. Collins, R. J. J. Chen and D. G. Elliot have provided an excellent, general review of NGL recovery methods in a paper presented at GasTech LNG/LPG Conference 84. This paper, entitled *Trends in NGL Recovery for Natural and Associated Gases*, was published by GasTech, Ltd. of Rickmansworth, England, in the transactions of the conference at pages 287–303. The pre-purified natural gas is treated by well known methods including absorption, refrigerated absorption, adsorption and condensation at cryogenic temperatures down to about −175° F. Separation of the lower hydrocarbons is achieved in one or more distillation towers. The columns are often referred to as de-methanizer or de-ethanizer columns. Processes employing a de-methanizer column separate methane and other more volatile components from ethane and less volatile components in the purified gas stream. The methane fraction is recovered as a purified gas for pipeline delivery. The ethane and less volatile components, including propane, are recovered as natural gas liquids. In some applications, however, it is desirable to minimize the ethane content of the NGL. In those applications, ethane and more volatile components are separated from propane and less volatile components in a column generally known as a de-ethanizer column.

An NGL recovery plant design is highly dependent on the operating pressure of the distillation column(s). At medium to low pressures, i.e., 400 psia or lower, the recompression horsepower requirement will be so high that the process becomes uneconomical. However, at higher pressures the recovery level of hydrocarbon liquids will be significantly reduced due to the less favorable separation conditions, i.e., lower relative volatility inside the distillation column(s). Prior art methods have concentrated on operating the distillation column(s) at higher pressures, i.e., 400 psia or higher while attempting to maintain high recovery of liquid hydrocarbons. In order to achieve these goals, some systems have included two towers, one operated at higher pressure and one at lower pressure.

Many patents have been directed to methods for improving this separation technology. For example, see U.S. Pat. No. 4,596,588 describing methods for separating hydrocarbon gases using a two-column system. Many of the methods disclosed in these patents sought to improve the separation technique by either increasing the reflux flow or providing a leaner or colder reflux stream to the distillation column near the top. For example, see U.S. Pat. Nos. 4,171,964 and 4,278,457. These patents disclose that the separation process may be improved by generating more reflux at colder temperature from a portion of the feed gas by heat exchange with the overhead vapor stream from the de-methanizer column. U.S. Pat. No. 4,687,499 discloses that the warmed and compressed overhead vapor stream should be further chilled and expanded before return to the de-methanizer column as reflux. In a still further variation, U.S. Pat. No. 4,851,020 discloses a cold recycle process wherein a recycle stream containing liquid at elevated pressure is returned to the top of a de-methanizer column to improve the ethane recovery in the NGL product. All of these prior art methods attempt to improve the NGL recovery processes by either generating leaner reflux or recycling a portion of the overhead vapor from the de-methanizer column after it has been compressed to an elevated pressure.

A significant cost in NGL recovery processes is related to the refrigeration required to chill the inlet gas. Refrigeration for these low temperature recovery processes is commonly provided by external refrigeration systems using ethane or propane as refrigerants. In some applications, mixed refrigerants and cascade refrigeration cycles have been used. Refrigeration has also been provided by turbo expansion or work expansion of the compressed natural gas feed with appropriate heat exchange.

Traditionally, the gas stream is partially condensed at medium to high pressures with the help of either external propane refrigeration, a turboexpander or both. The condensed streams are further processed in a distillation column, e.g., a de-methanizer or de-ethanizer, operated at medium to low pressures to separate the lighter components from the recovered hydrocarbon liquids. Turboexpander technology has been widely used in the last 30 years to achieve higher ethane and propane recoveries in the NGL for leaner gas. For richer gas containing significant quantities of heavy hydrocarbons, a combined process of turboexpander and external propane refrigeration is the most efficient approach.

While prior art methods have been capable of recovering more than 98% of the propane, propylene and higher hydrocarbons during the ethane recovery mode, most of those methods fail to maintain the same propane recovery level when ethane is unwanted and when operated in the ethane rejection mode. Traditionally, there have been four ways to increase propane recovery while operating in the ethane rejection mode. The operating pressure of the de-ethanizer may be reduced. This approach often includes a two-stage expander design to accommodate the higher expansion ratio more efficiently. Despite requiring a significant increase in recompression horsepower, these methods are capable of recovering up to about 90 percent of the propane in the gas feed.

An alternative approach is disclosed in U.S. Pat. No. 4,251,249. The '249 patent discloses the addition of a separator at the expander discharge to partially remove methane in the gas phase so that only the liquid is sent to the de-ethanizer for further processing. Addition of an overhead condenser to the de-ethanizer minimizes the propane loss in the overhead vaporstream. However, the propane loss in the separator vapor is still too great to permit this method to achieve more than 90 percent propane recovery.

The use of a propane-free or low propane reflux in an attempt to overcome the deficiencies of the '249 patent is disclosed in U.S. Pat. Nos. 4,657,571 and 4,690,702. An improved expander discharge separator design includes the addition of a packing section and use of a cold recycle stream from the de-ethanizer overhead as reflux. This reflux improves propane recovery from the expander discharge vapor in the new packing section. The content of propane in the overhead vapor stream exiting the de-ethanizer can be minimized and controlled by the reflux flow. While recovery of more than 98 percent of the propane is achievable with this system, the recycle of methane and ethane increases both the condenser and reboiler duties. Further, the size of the de-ethanizer must be increased.

In a related approach, U.S. Pat. No. 5,568,737 suggests a system for increasing ethane recovery by recycling the residue gas stream from the residue gas compressor discharge Because the residue gas contains the least amount of propane, recycle of a significant amount of the residue gas at a much higher pressure can generate more and leaner reflux, which may permit recovery of more than 98 percent of the propane during ethane rejection operation. However, the system disclosed in the '737 patent requires a significant increase in capital and incurs much higher operating costs caused by the penalty on compression horsepower.

In yet another prior approach, a second de-ethanizer column has been added to a system designed to recover ethane. The second de-ethanizer column is added to separate out the ethane stream from the ethane plus NGL stream recovered from the upstream de-methanizer bottom. Liquid product purity is controlled by a de-ethanizer bottom reboiler and propane loss in the ethane stream is minimized by controlling the tower reflux rate. The ethane stream is combined with the de-methanizer overhead as the plant residue gas. The level of propane recovery is tied to the level of ethane recovery in the de-methanizer. In general, about 96 percent of the propane can be recovered when operating at 70–75 percent ethane recovery in the de-methanizer. Because the refrigeration used to maintain high ethane recovery is non-recoverable, both the condenser and reboiler duties are increased, along with the size of the de-ethanizer as discussed above. For purposes of comparison with the present invention, this process will be used in later discussions herein.

As can be seen from the foregoing description, the prior art has long sought methods for improving the efficiency and economy of processes for separating and recovering propane and heavier natural gas liquids from natural gas. Accordingly, there has been a long felt but unfulfilled need for more efficient, more economical methods for performing this separation. The present invention provides significant improvements in efficiency and economy, thus solving those needs.

SUMMARY OF THE INVENTION

The present invention is directed to processes for the separation of propane, propylene and heavier hydrocarbons, i.e., the $C_{3+}$ hydrocarbons, from a hydrocarbon-containing gas feed under pressure. In their broadest sense, the processes include introducing a cooled gas/condensate feed into a first distillation column, e.g., a de-methanizer tower, at one or more feed trays. The gas/condensate feed is separated in the first column into a first gas phase primarily comprising methane and ethane and into a first liquid phase primarily comprising ethane, ethylene and heavier hydrocarbons, i.e., the $C_{2+}$ hydrocarbons. The first liquid phase is introduced into a second distillation column, e.g., a de-ethanizer tower, at one or more feed trays. In the second distillation column, the first liquid phase is separated into a second gas phase primarily comprising ethane and a second liquid phase primarily comprising $C_{3+}$ hydrocarbons. At least a portion of the second gas phase primarily comprising ethane is introduced into the first distillation column as an overhead reflux. Finally, the second liquid phase primarily comprising $C_{3+}$ hydrocarbons is recovered from the bottom of the second distillation column.

The economic advantages of the present invention are enhanced in a more preferred embodiment by cooling the second gas phase in countercurrent heat exchange with a condensed liquid withdrawn from a chimney tray located below the feed trays of the first distillation column. The cooled second gas phase is separated into a first fraction primarily comprising ethane for introduction into the first distillation column as an overhead reflux and a second, heavier fraction for introduction into the second distillation column as an overhead reflux. Another feature of the preferred embodiment is the cooling of the overhead reflux prior to introduction into the first distillation column. In the most preferred embodiment, the second gas phase and, accordingly, the overhead reflux to the first distillation column is substantially pure ethane. In the most preferred embodiment, the overhead reflux further comprises a portion, typically up to about 5 percent-by-volume, of the residue gas recovered from the first gas phase. The addition of a small amount of residue gas recycle at substantially the same pressure as the first distillation column not only increases the amount of total reflux flow, but also alleviates the concern of water freeze-up.

Another feature offering economic advantage is the cooling of the gas feed by countercurrent heat exchange with a refrigerant stream comprising a portion of the first liquid phase. As a result of this cooling, the refrigerant stream is partially vaporized and may be separated into a third liquid phase for introduction into the second distillation column via pumps and a third gas phase for introduction into the first distillation column as a stripping gas after compression and cooling.

The methods of the present invention permit the recovery in the second liquid of at least about 94 percent-by-weight of the $C_3$+, hydrocarbons in the gas feed. In fact, when optimized, the methods of the present invention permit the recovery of at least about 99 percent-by-weight of the $C_{3+}$ hydrocarbons in the gas feed. Such high recovery may be achieved while eliminating the external propane refrigeration required by prior systems, while reducing the size of the de-ethanizer column and while reducing the external heat requirement, the electrical load and utility cost, typically by more than fifty percent.

In addition, when liquid product values are rapidly changing, the flexible design of the present invention permits an easy switch between ethane recovery and ethane rejection modes. Accordingly, ethane product may be recovered in addition to the residue gas and NGL products normally produced when the market demand for ethane increases. The present invention meets these challenging demands.

Thus, the long felt but unfulfilled need for more economical and more efficient methods for separating and recovering $C_3$+, hydrocarbons from gas streams has been met. These and other meritorious features and advantages of the present invention will be more fully appreciated from the following detail description and claims.

BRIEF DESCRIPTION OF THE DRAWINGS

Other features and intended advantages of the present invention will be more readily apparent by the references to the following detailed description in connection with the accompanying drawings, wherein.

While the invention will be described in connection with the presently preferred embodiments, it will be understood that it is not intended to limit the invention to those embodiments. On the contrary, it is intended to cover all alternatives, modifications and equivalents as may be included in the spirit of the invention as defined in the appended claims.

DETAILED DESCRIPTION OF PREFERRED EMBODIMENTS

The present invention permits the separation and recovery of substantially all of the propane, propylene and heavier hydrocarbons, i.e. the $C_{3+}$ hydrocarbons, from compressed natural gas and refinery fuel gas feeds. The present invention achieves these results while eliminating the need for external propane refrigeration. By using at least a portion of the de-ethanizer overhead as a reflux to the de-methanizer tower, preferably after partial condensation through heat exchange with a portion of the de-methanizer side liquid, the external heat requirement, electrical load and utility costs may all be significantly reduced. Because of these improvements, the capital requirements and operating costs of recovering substantially all of the $C_{3+}$ hydrocarbons present in the feed gas may be greatly reduced.

For purposes of comparison, an exemplary prior process will be described with reference to FIG. 1. The methods of the present invention will be described with reference to FIGS. 2 and 5. To the extent that temperatures and pressures are recited in connection with the methods of the present invention, those conditions are merely illustrative and are not meant to limit the invention.

Figure 1:
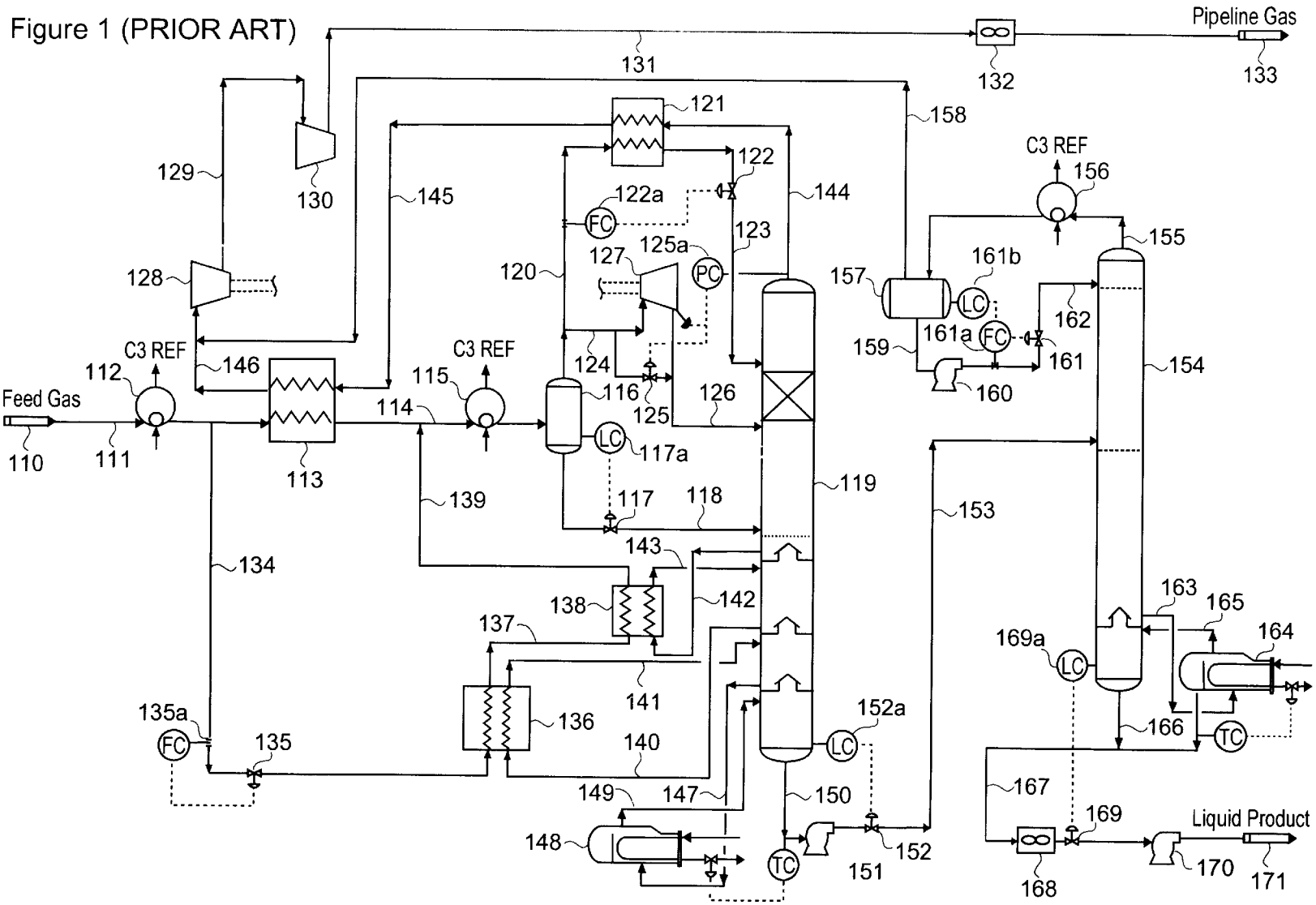
Figure 1 (PRIOR ART)
FIG. 1 is a schematic representation of a prior NGL separation process in accord with the description in the penultimate paragraph of the Description of the Background.

Referring to FIG. 1, a feed gas comprising a clean, filtered, dehydrated natural gas or refinery fuel gas stream is introduced into the illustrated process through inlet 110 at a pressure of about 1100 psia and a temperature not greater than about 90–110° F. In this conventional system, inlet stream 111 is cooled using external propane refrigeration in exchanger 112. After cooling, the stream is split with a first portion being further cooled in gas/gas heat exchanger 113 to a temperature of about −2° F. The second portion is directed through line 134 to reboiler heat exchanger 136. Flow through line 134 is controlled by flow control valve 135 operated in response to flow controller 135*a*. The cooled gas is directed from exchanger 136 through line 137 to a second reboiler heat exchanger 138 from which it emerges in reduced temperature feed line 139 at a temperature of about 30° F. The gases exiting heat exchangers 113 and 138 are combined in reduced temperature feed line 114 to form a stream at a temperature of about 20° F. This stream is further cooled with additional external propane refrigeration 115 to reduce the temperature of the stream to about −4° F., resulting in partial condensation of the feed gas.

The partially condensed feed gas is directed to expander feed separator 116 for separation of vapor and liquids. The liquids produced in separator 116 are withdrawn through level control valve 117 operated in response to level controller 117*a* and delivered through feed line 118 to de-methanizer column 119 operated at a pressure of about 455 psia. The vapor withdrawn from separator 116 is divided into two streams. The main portion, comprising about 60–65 percent-by-volume of the vapor, is directed via line 124 to expander 127 prior to entering de-methanizer 119 below the overhead packing section via feed line 126. Alternatively, the vapor in line 124 may by-pass expander 127 through pressure control valve 125 operated in response to pressure controller 125*a*. The remaining vapor portion, about 35–40 percent-by-volume, is directed via overhead recovery line 120 through reflux exchanger 121 where it is totally condensed and sub-cooled to a temperature of about −90° F. by countercurrent heat exchange with the overhead from de-methanizer 119. The condensed and sub-cooled vapor is flashed to the de-methanizer pressure of about 455 psia via feed line 123 through control valve 122 operated in response to flow controller 122*a*.

This system is intended to recover about 70 percent-by-weight of the ethane in the bottom NGL liquid withdrawn from the bottom of de-methanizer 119 through liquid recovery line 150. This recovery is controlled using bottom reboiler 148, together with cold side reboiler 138 and warm side reboiler 136, both heated with a small portion of the inlet gas directed by flow controller 135 through line 134. Liquid condensate is withdrawn via line 142 from a chimney tray below the lowest feed line of de-methanizer 119. After heating in cold side reboiler 138 to partially evaporate the liquid, the resulting liquid/vapor mixture is returned to de-methanizer 119 via return line 143. Similarly, liquid condensate from a lower chimney tray is withdrawn via line 140 for heating in warm side reboiler 136 to partially evaporate the liquid. The resulting liquid/vapor mixture is directed via return line 141 to de-methanizer 119. Condensate from a still lower chimney tray may be directed via line 147 through bottom reboiler 148 here sufficient heat is supplied by hot oil to partially evaporate the liquid. The resulting liquid/vapor mixture is returned to de-methanizer 119 via return line 149.

A de-ethanizer 154 is added downstream of de-methanizer 119. The withdrawal of the de-methanizer bottoms from de-methanizer 119 via liquid recovery line 150 is controlled by level control valve 152 operated in response to level controller 152*a*. These bottoms are pumped through line 153 and into de-ethanizer 154 to separate the ethane and any remaining lighter components, e.g., methane and carbon dioxide, from the $C_{3+}$ hydrocarbons. Product purity of the liquid withdrawn from the bottom of de-ethanizer 154 is controlled by de-ethanizer bottom reboiler 164. Like bottom reboiler 148, liquids withdrawn via line 163 from a lower chimney tray of de-ethanizer 154 are warmed via heat exchange with hot oil prior to return to the de-ethanizer via return line 165.

Ethane and lighter hydrocarbons are withdrawn from de-ethanizer 154 via overhead recovery line 155. The loss of propane in the ethane-rich stream exiting the de-ethanizer in line 155 may be minimized by the tower reflux rate which is controlled via the de-ethanizer reflux condenser 156 which provides external propane refrigeration, reflux drum 157 and reflux pump 160. Gases withdrawn via overhead line 155 are partially condensed using external propane refrigeration in exchanger 156. Condensed liquids are separated from the cooled gases in reflux drum 157 and withdrawn via line 159 for return as an overhead reflux to de-ethanizer column 154 through line 162 via control valve 161 in response to flow controller 161*a* and level controller 161*b*.

The ethane rich stream produced in drum 157 is withdrawn via line 158 for combination with the residue gas recovered from de-methanizer 119. The overhead from de-methanizer 119 is withdrawn via overhead recovery line 144. After providing refrigeration in reflux exchanger 121, this gas is directed via line 145 through gas/gas heat exchanger 113 where it provides further refrigeration to the inlet gas. The heated gas exiting exchanger 113 via line 146 is combined with the ethane rich stream 158 before recompression in expander/compressor 128. The partially compressed residue gas is directed via line 129 to residue gas compressor 130 where it is further compressed to the desired pipeline pressure, e.g., to about 1,100 psia. After compression, the residue gas is transported via outlet line 131 to compressor discharge cooler 132 and, finally, to gas product line 133.

The $C_{3+}$ hydrocarbons condensed at the bottom of de-ethanizer 154, are withdrawn via liquid recovery line 166 operated by level control valve 169 in response to level controller 169*a*. The separated $C_{3+}$ hydrocarbons are transported via line 167 into cooler 168. The chilled liquids are finally introduced via pump 170 into liquid product pipe line 171. The level of propane recovery from the bottom of de-ethanizer 154 is tied to the level of ethane recovery in de-methanizer 119. In general, about 96 percent of the propane in the gas feed may be recovered in the liquid in pipeline 171 when the system is operated with about 70–75 percent ethane recovery in recovery line 150 at the bottom of de-methanizer 119.

Figure 5:
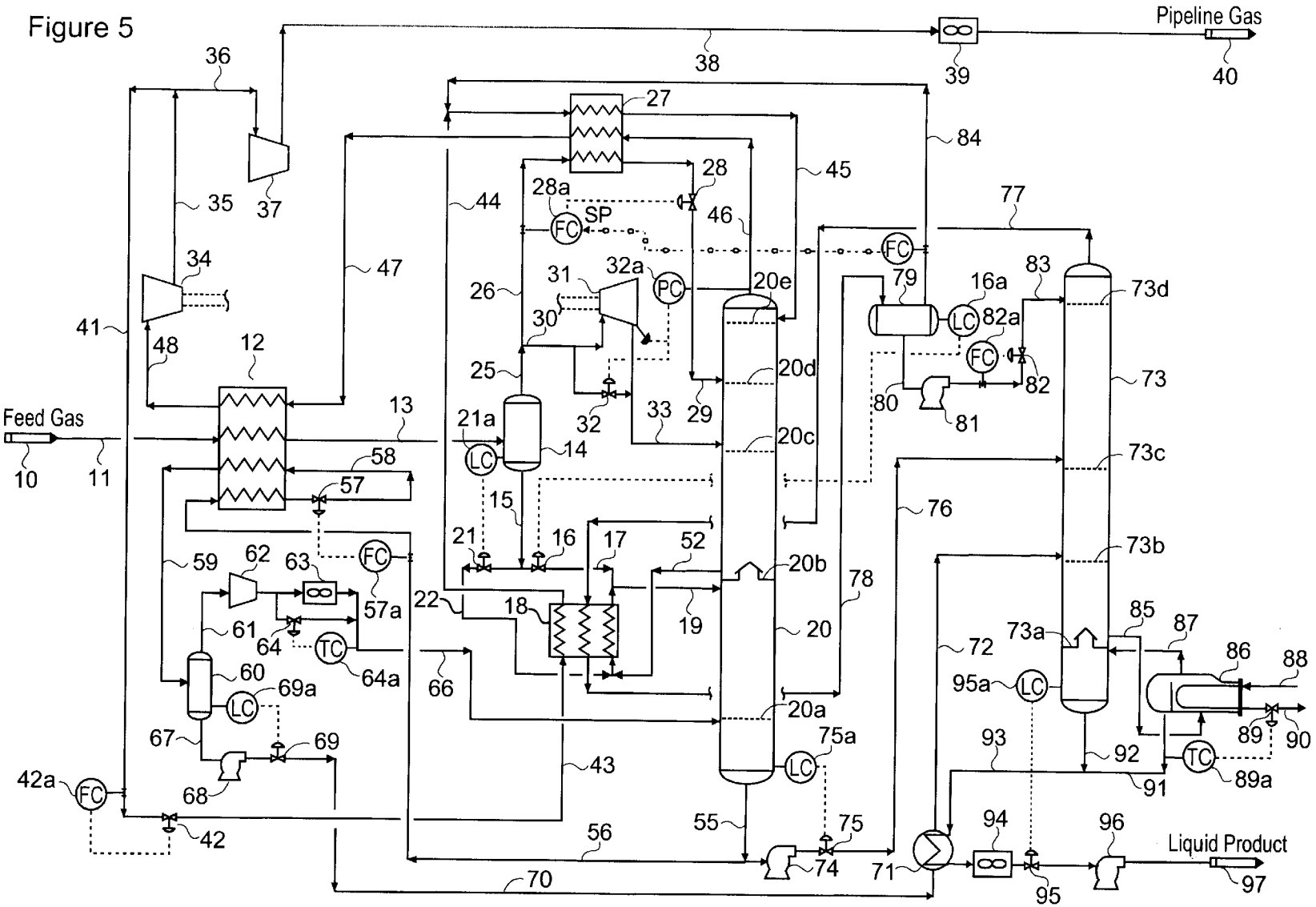
FIG. 5 is a schematic representation of a simplified NGL separation process incorporating the improvements of the present invention and configured to recover as a liquid product substantially all of the propane and heavier hydrocarbons from the dry feed gas.

The methods of the present invention will now be illustrated with reference to FIGS. 2 and 5. Because FIG. 5 illustrates a simplified system similar to FIG. 2, the same reference numerals have been used to represent the same system components in each figure.

Figure 2:
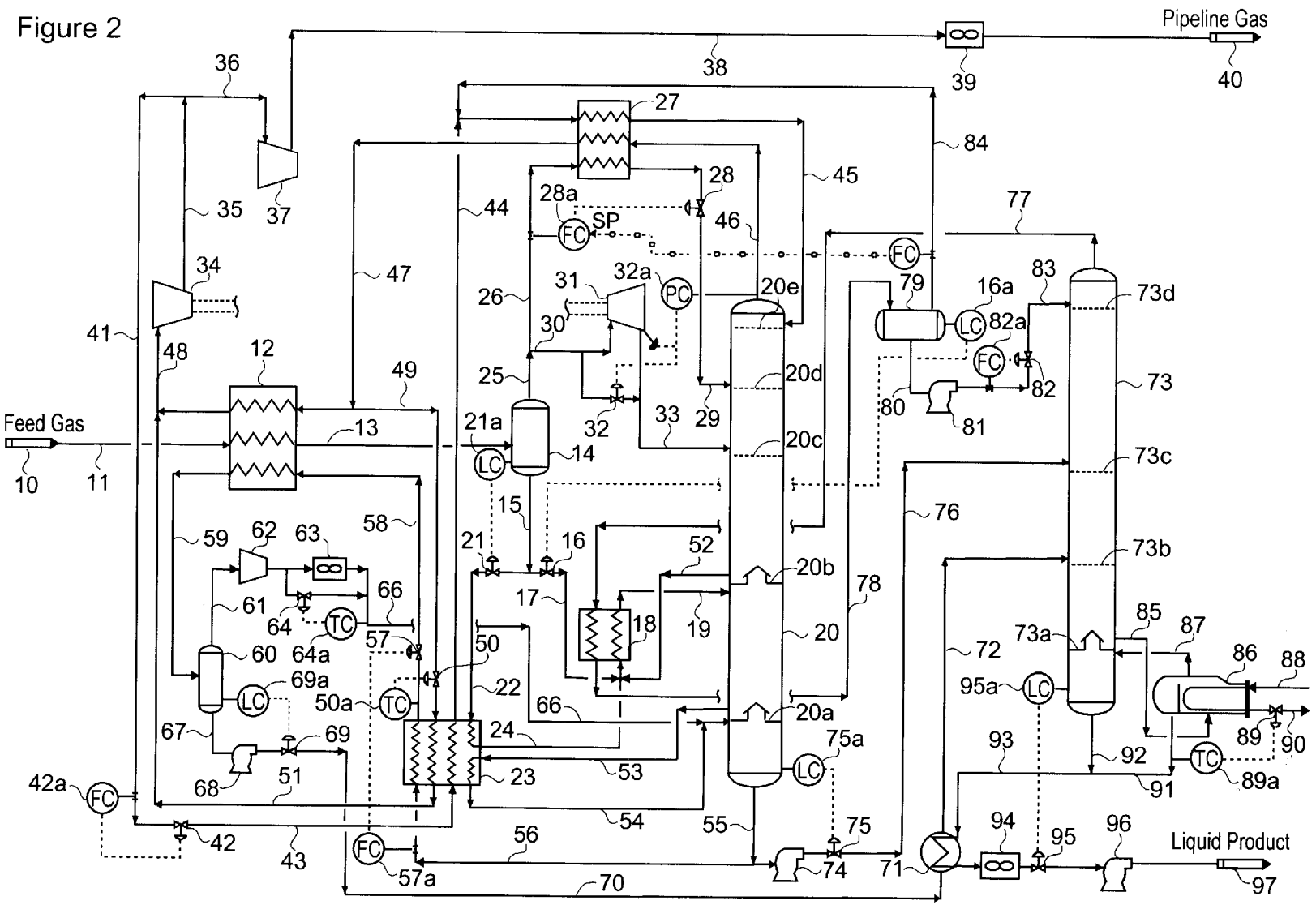
FIG. 2 is a schematic representation of an NGL separation process incorporating the improvements of the present invention configured to recover as a liquid product substantially all of the propane and heavier hydrocarbons of the dry feed gas.

Looking first at the system illustrated in FIG. 2, feed gas, typically comprising a clean, filtered, dehydrated natural gas or refinery fuel gas stream is introduced into the process through inlet 10 at a pressure of about 1100 psia and a temperature of about 90–110° F. The feed gas is carried by feed stream 11 to gas/gas heat exchanger 12 where it is cooled by countercurrent heat exchange to a temperature of about 15° F. before being carried by reduced temperature feed line 13 to expander feed separator 14.

The partially condensed feed stream is separated into liquid and vapor phases in separator 14. The liquid hydrocarbons are withdrawn from the bottom of separator 14 through liquid recovery line 15. This stream is then split, a first portion directed through level control valve 16 operated in response to level controller 16*a* and line 17 to reboiler heat exchanger 18. The remaining portion is directed through level control valve 21 operated in response to level controller 21*a* and line 22 through heat exchanger 23 to line 24 and also to reboiler heat exchanger 18. After absorbing heat in heat exchanger 23 and reboiler 18, the combined stream is directed via line 19 to a lower portion of de-methanizer 20.

Gases produced in expander feed separator 14 are withdrawn via overhead recovery line 25. These gases are split between line 26 directed to reflux exchanger 27 and line 30 directed to expander 31. Typically about 35 percent-by-volume of the vapor is directed to reflux exchanger 27, while the remaining 65 percent-by-volume flows to expander 31 or directly via line 33 to de-methanizer 20. Gases passing through reflux exchanger 27 are cooled and totally condensed by indirect heat exchange with the overhead vapor phase from de-methanizer 20. These condensed gases are directed into a feed tray near the top of de-methanizer 20 through feed line 29 at a temperature of about −100° F. and a pressure of about 440 psia. Flow through line 29 is controlled by flow control valve 28 operated in response to flow controller 28*a*.

A second portion of the vapor withdrawn from the top of separator 14 flows through line 30 to expander 31. The reduced pressure vapors from expander 31 pass via feed line 33 to an upper region of de-methanizer 20 at a temperature of about −55° F. and a pressure of about 440 psia. The configuration illustrated in FIG. 2 further includes pressure control valve 32 operated in response to pressure controller 32*a* to permit at least some of the gas to by-pass expander 31 when appropriate.

De-methanizer 20 operated at a pressure of about 440 psia has chimney trays 20*a* and 20*b* and feed trays 20*c*–20*e*. Liquid collected in chimney tray 20*b* of de-methanizer 20 is withdrawn via line 52 and heated by countercurrent heat exchange in side reboiler 18 prior to reintroduction to the de-methanizer via line 19. Similarly, liquid condensed in lower chimney tray 20*a* is withdrawn via line 53, partially vaporized in heat exchanger 23 and re-introduced to the de-methanizer via return line 54.

Lighter gases, primarily methane and ethane are withdrawn from the top of de-methanizer 20 via overhead recovery line 46. After absorbing heat in reflux exchanger 27, the gas in line 47 is split into two streams. The first portion absorbs still more heat in heat exchanger 12 while cooling the inlet gas. The second portion directed through line 49 controlled by temperature control valve 50 in response to temperature controller 50*a* is directed through heat exchanger 23 to absorb additional heat. After being heated the gas passes through line 51 before joining in line 48 with the heated gas exiting heat exchanger 12 prior to being compressed in expander compressor 34.

The compressed gas exiting compressor 34 in line 35 is split, the major portion carried by line 36 to residue gas compressor 37 where it is further compressed to the desired pipeline pressure, e.g., to about 1,100 psia. The compressed gas is transported via outlet line 38 to compressor discharge cooler 39 and eventually enters gas product line 40.

A small portion of the residue gas in line 35 may be recycled to the de-methanizer reflux. Typically the recycled portion is not more than about 5 percent-by-volume of the residue gas, although recycle of up to 10 percent-by-volume may be used in some circumstances to control ice formation in reflux exchanger 27. This recycled gas is directed via lines 41 and 43 to heat exchanger 23 where it is initially cooled. The flow in lines 41, 43 is controlled by flow control valve 42 operated in response to flow controller 42*a*. The cooled, recycled gas is then directed via line 44 to reflux exchanger 27 for further cooling.

The heavier liquids are withdrawn from de-methanizer 20 through liquid recovery line 55. This liquid stream is split, with a first portion comprising about 65 percent-by-weight of the liquid, being directed via line 56 through heat exchanger 23 where it is cooled. The cooled liquid is transported through flow control valve 57 operated in response to flow controller 57*a* and line 58 to heat exchanger 12 to provide additional refrigeration to cool the inlet gas. Stream 59 carries partially vaporized hydrocarbon liquids exiting heat exchanger 12 to suction knockout drum 60 where the partially vaporized stream is separated into vapor and liquid streams. The vapor phase produced in knockout drum 60 is withdrawn through suction flow line 61 to recycle compressor 62. The re-pressurized gas exiting compressor 62 is cooled in recycle compressor cooler 63 prior to reintroduction to de-methanizer 20 as a stripping gas through line 66 at a temperature of about 115° F. The temperature of the compressed, cooled vapor is adjusted using by-pass temperature control valve 64 operated in response to temperature controller 64*a*.

The liquid phase accumulated at the bottom of knockout drum 60 is withdrawn through line 67. This liquid phase is pumped by recycle pump 68 operated by level control valve 69 in response to level controller 69*a* via line 70 through heat exchanger 71. It enters de-ethanizer 73 at tray 73*b* through feed line 72 at a temperature of about 185° F.

The remaining portion of the condensed liquid recovered in liquid recovery line 55, comprising about 35 percent-by-weight of the liquid, is pumped directly through line 76 by pump 74 into feed tray 73*c* of de-ethanizer 73. Flow through line 76 is controlled by level control valve 75 operating in response to level controller 75*a*.

The liquid feed input to de-ethanizer 73 at trays 73*b* and 73*c* comprises ethane, propane and heavier hydrocarbons. These liquids are separated in de-ethanizer 73 operated at a pressure of about 460 psia into a vapor comprising mainly ethane, ethylene and lighter hydrocarbons, i.e., the $C_{2+}$ hydrocarbons, and into a liquid comprising mainly propane, propylene and heavier hydrocarbons, i.e., the $C_{3+}$ hydrocarbons.

The vapor phase comprising mainly ethane is withdrawn from the top of de-ethanizer 73 through overhead recovery line 77. This vapor phase comprises mainly ethane, together with carbon dioxide present in the feed gas. The ethane and carbon dioxide comprise at least 85 percent-by-volume, typically more than 94 percent-by-volume, of the overhead. This vapor phase is cooled in side reboiler 18 prior to return via line 78 to reflux drum 79 at a temperature of about 45° F. In contract, the condenser duty on the de-ethanizer overhead was provided by external propane refrigeration in prior art systems. Applicants' method provides refrigeration by partially vaporizing the side liquid withdrawn via line 52 from de-methanizer 20 in an exchanger 18 normally called a side reboiler. The two phase stream at the exit of exchanger 18 is returned to de-methanizer 20 via line 19.

Side reboilers are commonly used in the gas processing industry. In fact, an integration of a reboiler and condenser is commonly used in the air separation industry. In this integrated system, both sides of the exchanger turn up and down at the same time. However, this type of integration suffers from the loss of flexibility. This disadvantage is illustrated by the dashed line in FIG. 3 which illustrates the benefit of the lower exchanger surface area throughout a wider temperature approach achieved by use of the refrigerant aid provided by the present invention in exchanger 18. A conventional side reboiler alone is incapable of supplying more refrigeration or condenser duty as indicated by the temperature crossover in FIG. 3.

Figure 3:
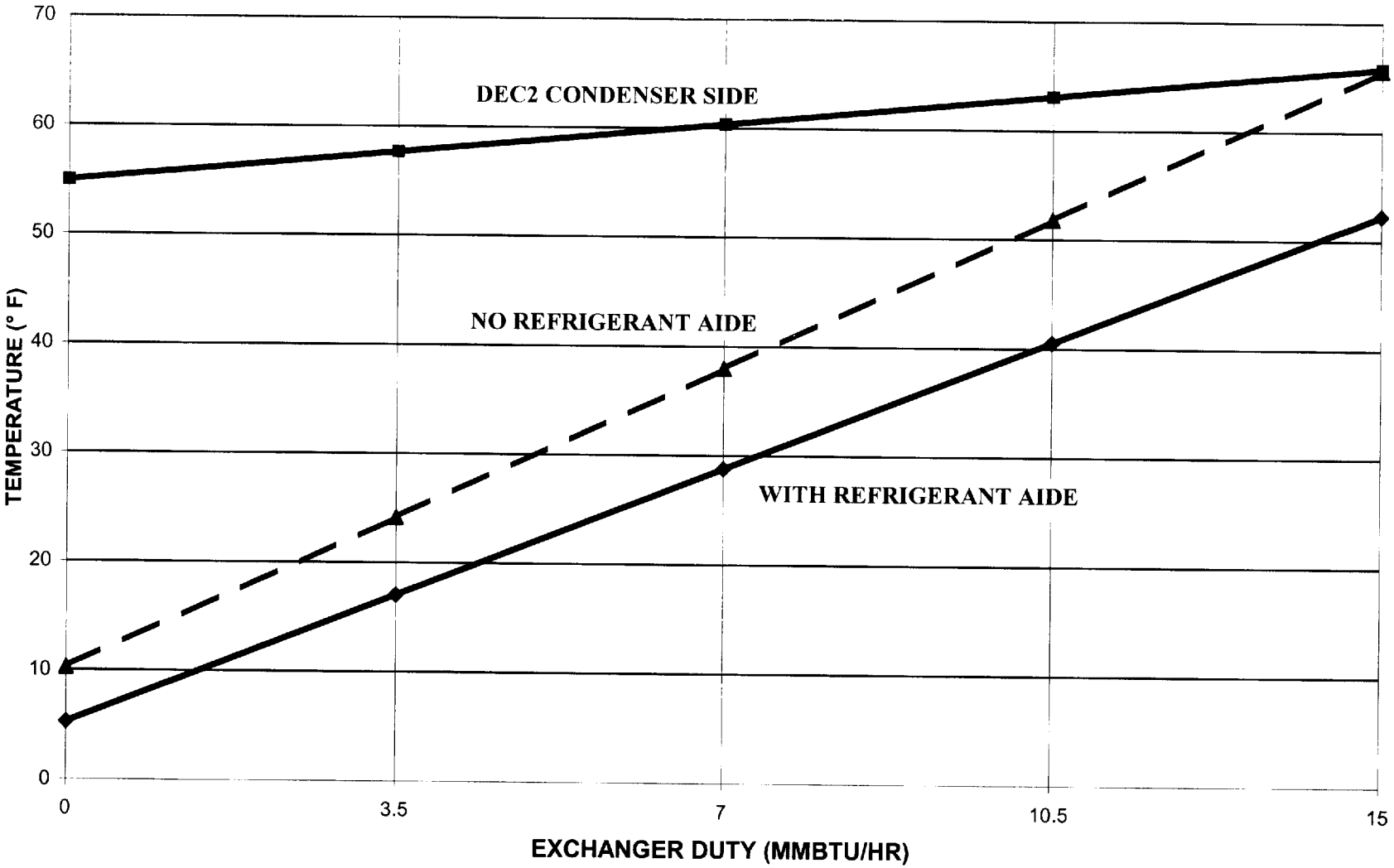
FIG. 3 is a graph illustrating the benefit of refrigerant aid in accord with the present invention.

If the side reboiler side is considered as a form of self refrigeration, then it is necessary to provide a refrigerant aid to regain flexibility and controllability. A natural source of refrigerant aid is the liquid withdrawn from separator 14 at high pressure prior to introduction of the feed to expander 31. Alternatively, any liquid condensed and separated out from the plant feed gas at higher pressure which still contains a sufficient amount of methane may be used. FIG. 3 illustrates that the addition of refrigerant aid actually widens the temperature approaches, i.e., the exchanger area requirement is reduced by more than about 25 percent, and gives much more flexibility in adjusting the condenser duty.

With reference to FIG. 2, the partially condensed stream is separated in reflux drum 79 into vapor and liquid phases. The vapor phase withdrawn through line 84 comprises substantially pure ethane which, after being cooled in reflux exchanger 27 is transported via line 45 to upper tray 20*e* as an overhead reflux to de-methanizer 20 at a temperature of about −80° F. and a pressure of about 440 psia. In the illustrated embodiment, the substantially pure ethane in line 84 is mixed with a portion of the residue gas in line 44 before cooling and introduction as the overhead reflux.

Recycle of stream 84 from reflux drum 79 back to de-methanizer 20 as a cold reflux raises a common concern in those skilled in the art. That concern is the possibility that water vapor in the recycle stream will be sufficiently concentrated so that ice and/or hydrates will form in reflux exchanger 27. Prior attempts to recycle the overhead resulted in the formation of ice and/or hydrates within the exchanger passages. In fact, complete blockage occurred when the operating temperature inside the reflux exchanger was lower than about −105° F. Blockage could be eliminated by operating the exchanger at a temperature above about −85° F. Therefore, the operating temperature of the recycle stream should be increased to a temperature of about −85° F. or higher to prevent ice and/or hydrate formation and blockage in exchanger 27. While the temperature may be increased by increasing the operating pressure of the de-methanizer 20, product recovery is adversely affected. Similarly, while the increased temperature may be achieved by reducing the surface area of exchanger 27, the cost is paid by reduced liquid recovery.

Applicant has solved this problem by adding to the de-methanizer reflux a small quantity of the residue gas recycled from downstream of the expander-compressor 34 or from a separate low head booster compressor. Condensation of the mixture comprising the ethane rich stream 84 from the de-ethanizer and this light gas stream 44 is achievable at the same pressure as de-methanizer 20. Residue gas recycle for this application offers the following advantages:

- Higher liquid recovery is achieved by diluting the propane content in the liquid reflux to minimize equilibrium propane loss in the residue gas.
- Higher liquid recovery is achieved by increasing the total liquid reflux.
- Ice and/or hydrate formation in the reflux exchanger is minimized by diluting the moisture content in the reflux.

Ice and/or hydrate formation is minimized by increasing the operating temperature inside the reflux exchanger passages.

Figure 4:
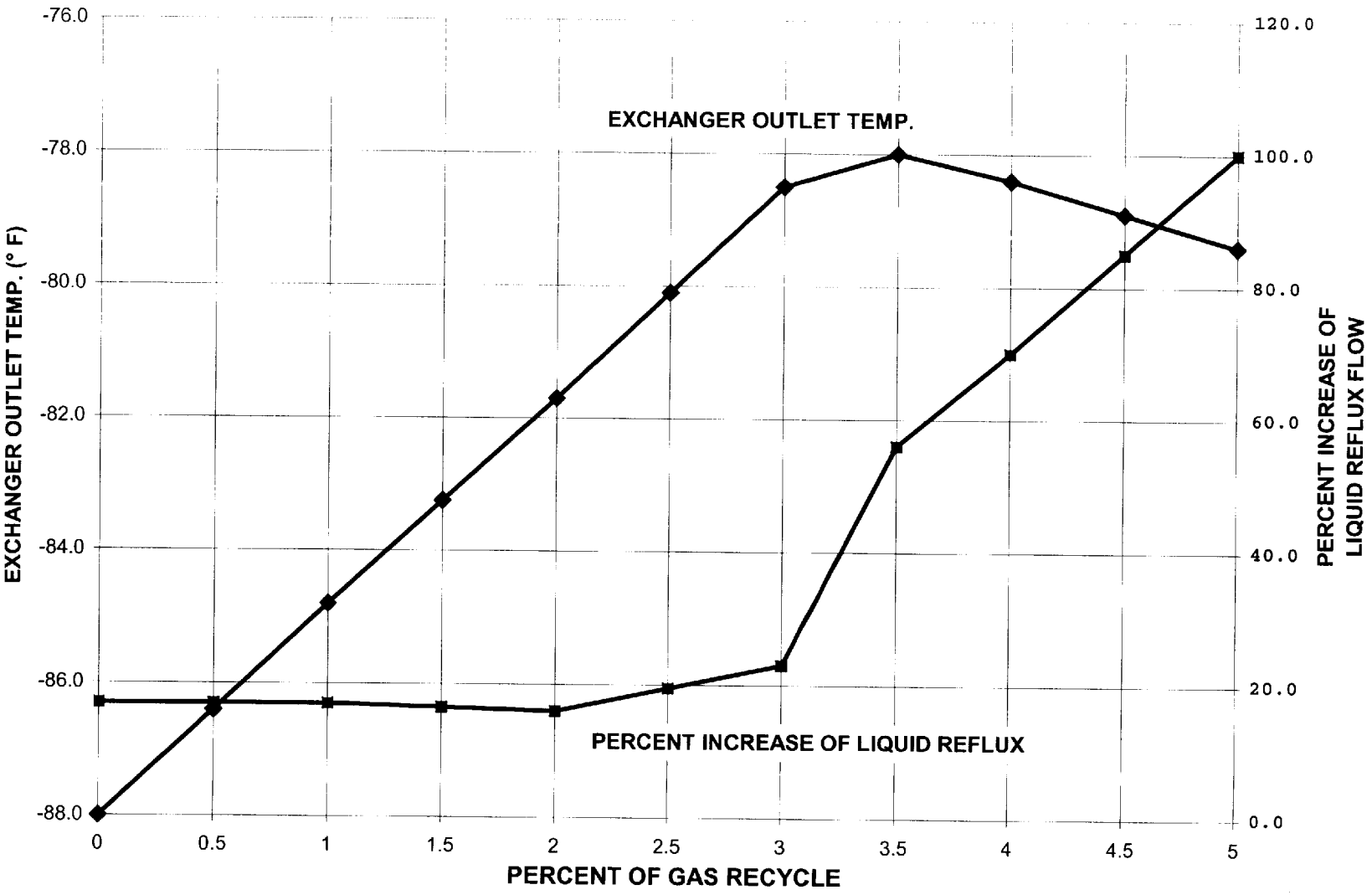
FIG. 4 is a graph illustrating the effect on the exchanger outlet temperature and the liquid reflux flow achieved by recycling a small portion of the residue gas.

FIG. 4 illustrates the advantages of using a small quantity of recycled gas in this manner. The recycle gas flow is varied from 0 to about 5 percent-by-volume of the total residue gas, while keeping the exchanger surface area the same. When there is no recycle gas, the exchanger outlet temperature is about −86° F. As the recycle flow increases, the outlet temperature remains almost constant, while the total liquid reflux flow increases proportionately, because the mixed reflux stream is totally condensed until the recycle rate exceeds about 3 percent-by-volume. Further increase in the recycle flow results in partial condensation and increase in the outlet temperature from about −86° F. to about −78° F. At these warmer temperatures, the liquid reflux flow is still about double, producing 100 percent more liquid reflux while the penalty on liquid recovery has been reduced to a minimum. Accordingly, the problem of water and hydrates freezing in the reflux exchanger can be avoided while at the same time improving liquid recovery. Further, because the flow and differential head requirements of this recycle flow are both low, the penalty on compression horsepower is limited.

Returning to FIG. 2, the liquid accumulated in reflux drum 79 is withdrawn via line 80 and pump 81. This liquid is reintroduced to de-ethanizer tower 73 at tray 73*d* as an overhead reflux through feed line 83 via flow control valve 82 operated in response to flow controller 82*a*.

The purity of the $C_{3+}$ hydrocarbon liquids accumulated at the bottom of de-ethanizer 73 is controlled by bottom reboiler 86. Liquid condensate is withdrawn from a lower chimney tray 73*a* via line 85, heated in bottom reboiler 86 and returned via line 87 at a temperature of about 220° F. and a pressure of about 465 psia. External heat is supplied to reboiler 86 via hot oil entering line 88 and exiting line 90, controlled via temperature control valve 89 operated in response to temperature controller 89*a*.

The desired $C_{3+}$ hydrocarbon product is accumulated at the bottom of de-ethanizer 73 where it may be withdrawn through liquid recovery line 92 operated by level control valve 95 in response to level controller 95*a*. The withdrawn product is transported via line 93 to exchanger 71 and cooler 94. The final $C_{3+}$ product is moved via pump 96 to liquid product pipeline 97.

FIG. 5 illustrates a presently preferred, simplified system for separating and recovering $C_{3+}$ hydrocarbons in accord with the methods of the present invention. Because the system illustrated in FIG. 5 is substantially the same as that illustrated in FIG. 2, like reference numerals have been used to describe like components. Further, because of the substantial similarity of these processes a separate, detailed recitation of the process illustrated in FIG. 5 will not be included. Only that portion which differs will be discussed in detail.

In general, the system illustrated in FIG. 5 has been simplified to eliminate heat exchanger 23. Liquid withdrawn from the bottom of expander feed separator 14 through liquid recovery line 15 is again split. However, the liquid flowing through level control valve 16 and line 17 is conducted directly through line 19 into de-methanizer 20. The remaining portion of the liquid withdrawn from separator 14 passes through level control valve 21 and line 22 directly into side reboiler 18 where it is heated prior to introduction to de-methanizer 20 through line 19. This arrangement allows the temperature of the fluid in line 19 to be more easily controlled.

The small portion of the residue gas recycled through lines 41, 43 is cooled by passage through side reboiler heat exchanger 18 prior to being conveyed by line 44 for combination with the substantially pure ethane stream of line 84. In this embodiment, the bottom reboiler has been completely eliminated, being replaced by the warm stripping gas returning via line 66. In all other respects, the system illustrated in FIG. 5 is substantially identical to that in FIG. 2 and, accordingly, operates in the same manner and at the same temperatures and pressures.

The systems in the figures described will now be discussed in relation to specific examples. These discussions are based upon a 400 MMSCFD natural gas feed at 1,115 psia and a required pipeline delivery pressure of 1,115 psia.

The improvements achieved by the present invention result, at least in part, from controlling the propane to ethane ratio in the overhead reflux in line 84 to de-methanizer 20. The propane to ethane ratio in the overhead vapor from de-ethanizer reflux drum 79 is limited to no more than about 2 percent-by-weight which is much lower than the 60–80 percent-by-weight in overhead reflux line 123 to de-methanizer 119 of the system illustrated in FIG. 1. Instead of being combined with the residue gas, this low propane stream is totally condensed and further sub-cooled in reflux exchanger 27 prior to introduction to de-methanizer 20 as an overhead reflux to the propane recovery section added on top of a conventional de-methanizer.

The introduction of essentially pure ethane recycle as the overhead reflux permits recovery of substantially 100 percent of the propane in the feed gas. However, such recycle tends to increase the total ethane delivered to the de-ethanizer and, accordingly, would penalize the overall design. Therefore, it is preferred to cut the total ethane content of the overhead reflux to less than 50 percent of the base case while maintaining an optimal propane recovery level of about 98.5–99.5 percent-by-weight. This can be achieved by recycling a small portion of the residue gas, preferably not more than about 5 percent-by-volume, from the expander compressor discharge 35. The pressure of this recycled residue gas is substantially equal to, and preferably not more than about 10 psi greater than, the pressure of the ethane recycle. Because the pressure is too low to condense any significant amount of liquid, this gas cannot be used alone as the reflux. However, in combination with the substantially pure ethane stream 84 recycled from de-ethanizer overhead 77, the total liquid reflux is almost doubled after cooling. The combined recycle stream contains a minimal amount of propane. This feature causes only a small penalty of about five percent in expander compressor horsepower while resulting in higher propane recovery and permitting a reduction in de-ethanizer size. In operation, approximately 5 percent of the residue gas from expander compressor 34 is first cooled in heat exchanger 23 (FIG. 2) or 18 (FIG. 5) prior to mixing with pure ethane recycle for partial condensation in reflux exchanger 27. While increasing the residue gas recycle above about five percent-by-volume will not increase the total low propane reflux further, it will increase the temperature of the liquid exiting reflux exchanger 27. Accordingly, higher residue gas recycle, i.e., up to about ten percent-by-volume, may be used to avoid ice formation in the passages of reflux exchanger 27 or even to defrost ice formed there, if necessary. Further, it will reduce the back pressure of de-ethanizer 73 and with minimal increase in the recompression requirement.

In summary, the use of low propane reflux provides an efficient way to recover substantially all of the propane and heavier hydrocarbons without the traditional external refrigeration requirement for the reflux stream. The flow of the reflux stream, now the middle reflux, can be reduced to avoid penalizing the de-ethanizer design.

De-methanizer side reboiler 18 and the preheat portion of the flashed liquid withdrawn from expander feed separator 14 may both be used to reduce ethane recycle. The degree of preheat or the amount of so-called refrigerant aid can be adjusted by varying the by-pass flow. As the preheat temperature is increased, less refrigeration is required and less ethane recycled. Since the de-methanizer side reboiler 18 turns up and down at the same rate as the de-ethanizer condenser, these may integrated together in a side reboiler/condenser exchanger. In addition, the degree of preheat is added into the integration for more flexibility and faster response and control. The preheat temperature may be adjusted lower if more condenser duty is required for the de-ethanizer. An important feature is the mixing of the flashed liquid in lines 17, 24 (FIG. 2) or line 22 (FIG. 5) with the liquid in line 52 coming from de-methanizer chimney tray 20*b*. The lighter components contained in the flashed liquid enhance the vaporization of heavier molecular weight liquids from de-methanizer 20 and improve the heating/cooling integration.

The combination of all of the above improvements results in significant reduction in ethane recycle flow out of the de-ethanizer overhead. Recycle has been reduced from about 40 MMSCFD to about 16 MMSCFD when comparing the system illustrated in FIG. 1 with that of FIG. 2. As a result, the duty of the de-ethanizer condenser has been reduced from about 25 MMBtu/hr to about 15 MMBtu/hr and the reboiler duty reduced from about 59 MMBtu/hr to about 29 MMBtu/hr. Accordingly, the volume of de-ethanizer 73 may be reduced by almost fifty percent.

One of the disadvantages of the prior system illustrated in FIG. 1 is the heavy demand for external propane refrigeration. For example, the total demand has been calculated to be as great as 72 MMBtu/hr at different temperature levels for a 400 MMSCFD gas plant. This demand requires the use of a pair of 5,000 HP refrigeration compressors. With the process of the present invention more than 50 percent of the liquid recovered from the bottom of de-methanizer 20 is used as a self-refrigerant in gas/gas exchanger 12. In the embodiment illustrated in FIG. 2, this liquid has been first sub-cooled in exchanger 23 and flashed to a lower pressure. Self-refrigeration is provided to cool down the inlet gas by partially vaporizing the colder refrigerant stream at a lower pressure. The two phase refrigerant stream is then separated in suction knockout drum 60. The liquid phase is pumped directly to de-ethanizer 73 while the vapor phase is recycled back to de-methanizer 20 as a stripping gas. Use of self-refrigeration and the resulting stripping gas provides the following advantages:

The self-refrigeration loop of the present invention partially rejects ethane and reduces the total ethane carried to the de-ethanizer. Therefore, the volume of the de-ethanizer may be reduced.

The self-refrigeration system of the present invention completely replaces the complex and expensive propane refrigeration systems of the prior art.

The compression requirement for the self-refrigeration system of the present invention is reduced to about 26% of the base case, i.e., only requiring a pair of 1,300 HP compressors. Further, these compressors may be easily integrated with the residue gas compression system either through a tandem drive or a common compressor casing arrangement, thus allowing the self refrigeration system to turn down at the same rate with the residue gas compression.

The stripping gas of the present invention reduces the overall reboiler duty requirement for the de-methanizer. As the temperature of the stripping gas increases, the bottom reboiler duty decreases. This allows the bottom temperature of the de-methanizer to be increased, thus minimizing the total methane/ethane flowing downstream to the de-ethanizer. A bottom reboiler for the de-methanizer may still be provided (FIG. 2) to gain as much heat as possible while cooling the recycled residue gas and refrigerant for minimizing the total refrigeration requirement. However, as illustrated in FIG. 5, the bottom reboiler normally required for the de-methanizer may be eliminated.

The stripping gas of the present invention recycles ethane and propane back to the de-methanizer and increases the traffic of ethane therein, both reducing the temperature profile for a better heating/cooling integration.

The stripping gas of the present invention increases the relative volatility of the two key components, i.e., ethane and propane, thus enhancing the separation efficiency inside the tower and increasing the recovery of propane and heavier hydrocarbons.

The advantages in improved propane recovery, reduced energy requirements and reduced de-ethanizer size are illustrated in the following table:

| | Prior System (FIG. 1) | Claimed System (FIG. 2 or 5) |
|---|---|---|
| $C_{3+}$Recovery (%) | 96 | 99 |
| External Refrigeration Requirement | Yes | No |
| Propane Refrigeration (HP) | 2 × 5,000 | 0 |
| Residue Gas Compression (HP) | 2 × 10,500 | 2 × 9,500 |
| Enhancement Recycle (HP) | 0 | 2 × 1,300 |
| External Heat (MMBtu/hr) | 66 | 29 |
| De-ethanizer Diameter (ft.) | 12.5 | 9.0 |

The foregoing description has been directed in primary part to two particular preferred embodiments in accordance with the requirements of the Patent Statutes and for purposes of explanation and illustration. It will be apparent, however, to those skilled in the art that many modifications and changes in the specifically described methods and apparatus may be made without departing from the true scope and spirit of the invention. For example, while the systems have been illustrated with a typical turboexpander processing facility, the invention described herein can be adapted for use with any other expander plant design to achieve similar results. Further, while the illustrated embodiments operate with the pressure in de-ethanizer 73 higher than that in de-methanizer 20 by using a pump to increase the pressure from the bottom of the de-methanizer, an alternative apparatus would employ a compressor for the overhead gas from the de-ethanizer so that it could operate at a lower pressure than the de-methanizer. Therefore, the invention is not restricted to the preferred embodiments described and illustrated but covers all modifications which may call within the scope of the following claims.

What is claimed is:

1. A process for the separation of $C_{3+}$ hydrocarbons from a hydrocarbon-containing gas feed under pressure, comprising:

introducing a cooled gas/condensate feed into a de-methanizer column at one or more feed trays;

providing heat to a portion of said de-methanizer column below said feed trays to substantially strip off methane and ethane from said gas/condensate feed;

separating said gas/condensate feed in said de-methanizer column into a first gas phase primarily comprising methane and ethane and into a first liquid phase primarily comprising $C_{2+}$ hydrocarbons;

introducing said first liquid phase into a de-ethanizer column at one or more feed trays;

separating said first liquid phase in said de-ethanizer column into a second gas phase primarily comprising ethane and a second liquid phase primarily comprising $C_{3+}$ hydrocarbons;

cooling said second gas phase by countercurrent heat exchange with a mixture comprising condensed liquid withdrawn from said de-methanizer column at a tray located below said feed trays and a portion of liquid separated from said gas/condensate feed before its introduction into said de-methanizer column;

separating said cooled second gas phase into a first gaseous fraction primarily comprising ethane and a second liquid fraction;

cooling and condensing said first gaseous fraction primarily comprising ethane;

introducing into said de-methanizer column as an overhead reflux said cooled and condensed first gaseous fraction primarily comprising ethane;

introducing into said de-ethanizer column said second liquid fraction; and recovering from the bottom of said de-ethanizer column said second liquid phase primarily comprising $C_{3+}$ hydrocarbons.

2. The process of claim 1 wherein at least about 94% by weight of the $C_{3+}$ hydrocarbons in said gas feed are recovered in said second liquid phase.

3. The process of claim 1 wherein ethane and carbon dioxide comprise at least about 85 percent-by-volume of said first gaseous fraction of said second gas phase.

4. The process of claim 1 wherein said first gas phase is heated by countercurrent heat exchange with at least one of said first gaseous fraction and said gas feed and thereafter compressed to produce a residue gas.

5. The process of claim 1 wherein said overhead reflux further comprises a portion of said residue gas.

6. The process of claim 5 wherein up to about 5 percent-by-volume of said residue gas is included in said overhead reflux.

7. The process of claim 6 wherein the pressure of said included residue gas is substantially equal to the pressure of said first gaseous fraction.

8. The process of claim 5 further comprising including in said overhead reflux a sufficient volume of residue gas to prevent the formation of solids comprising ice, hydrates and mixtures thereof in said overhead reflux.

9. The process of claim 8 wherein up to about 10 percent-by-volume of said residue gas is included in said overhead reflux to prevent the formation of solids comprising ice, hydrates and mixtures thereof.

10. The process of claim 1 wherein said gas feed is cooled by countercurrent heat exchange with a refrigerant stream comprising a portion of said first liquid phase and resulting in partial vaporization of said refrigerant stream; and separating said partially vaporized refrigerant stream into a third liquid phase which is introduced into said de-ethanizer column and a third gas phase which is introduced into said de-methanizer column as a stripping gas.

11. The process of claim 10 wherein said refrigerant stream is drawn from one or more trays located below the first feed tray of said de-methanizer.

12. The process of claim 10 wherein said refrigerant stream is further cooled prior to supplying refrigeration for said feed gas.

13. The process of claim 10 wherein said third gas phase is partially condensed by compressing and cooling.

14. The process of claim 13 wherein said mixture used to cool said second gas phase is introduced back into said de-methanizer a location below the tray from which said condensed liquid was withdrawn.

15. A process for the separation of $C_{3+}$ hydrocarbons from a hydrocarbon-containing gas feed under pressure, comprising:

introducing a cooled gas/condensate feed into a first distillation column at one or more feed trays;

providing heat to a portion of said first distillation column below said feed trays to substantially strip off methane and ethane from said gas feed;

separating said gas/condensate feed in said first column into a first gas phase primarily comprising methane and ethane and into a first liquid phase primarily comprising $C_{2+}$ hydrocarbons;

introducing said first liquid phase into a second distillation column at one or more feed trays;

separating said first liquid phase in said second distillation column into a second gas phase primarily comprising ethane and a second liquid phase primarily comprising $C_{3+}$ hydrocarbons;

cooling and condensing said second gas phase primarily comprising ethane;

introducing into said first distillation column as an overhead reflux at least a portion of said cooled and condensed second gas phase primarily comprising ethane; and recovering from the bottom of said second distillation column said second liquid phase primarily comprising $C_{3+}$ hydrocarbons.

16. The process of claim 15 wherein at least about 94 percent-by-weight of the $C_{3+}$ hydrocarbons in said gas feed are recovered in said second liquid phase.

17. The process of claim 15 wherein ethane and carbon dioxide comprise at least about 85 percent-by-volume of said second gas phase.

18. The process of claim 15 wherein said overhead reflux further comprises a portion of a residue gas recovered from said first gas phase.

19. The process of claim 18 wherein up to about 5 percent-by-volume of said residue gas is included in said overhead reflux.

20. The process of claim 19 wherein the pressure of said 5 percent-by-volume of residue gas is substantially equal to the pressure of said second gas phase.

21. The process of claim 18 further comprising including in said overhead reflux a sufficient volume of residue gas to prevent the formation of solids comprising ice, hydrates and mixtures thereof in said overhead reflux.

22. The process of claim 21 wherein up to about 10 percent-by-volume of said residue gas is included in said overhead reflux to prevent the formation of solids comprising ice, hydrates and mixtures thereof.

23. The process of claim 15 wherein said gas feed is cooled by countercurrent heat exchange with a refrigerant stream comprising a portion of said first liquid phase and resulting in partial vaporization of said refrigerant stream; and separating said partially vaporized refrigerant stream into a third liquid phase which is introduced into said second distillation column and a third gas phase which is introduced into said first distillation column as a stripping gas.

24. The process of claim 23 wherein said refrigerant stream is drawn from one or more trays below the first feed tray of said first column.

25. The process of claim 23 wherein said refrigerant stream is cooled prior to supplying refrigeration for said gas feed.

26. The process of claim 24 wherein said third gas phase is partially condensed by compressing and cooling.

27. The process of claim 15 wherein the said second gas phase after cooling is separated into a first fraction primarily comprising ethane for introduction into said first distillation column as the overhead reflux and a second fraction for re-introduction into said second distillation column.

28. A process for the separation of $C_{3+}$ hydrocarbons from a hydrocarbon-containing gas feed under pressure, comprising:

introducing a cold gas/condensate feed into a first distillation column at one or more feed trays;

separating said gas/condensate feed in said first distillation column into a first gas phase primarily comprising methane and ethane and into a first liquid phase primarily comprising $C_{2+}$ hydrocarbons;

heating and compressing said first gas phase to produce a residue gas for delivery to a pipeline;

introducing said first liquid phase into a second distillation column at one or more feed trays;

separating said first liquid phase in said second distillation column into a second gas phase primarily comprising ethane and a second liquid phase primarily comprising $C_{3+}$ hydrocarbons;

cooling said second gas phase by countercurrent heat exchange with a condensed liquid withdrawn from said first distillation column at a tray located below said feed trays;

separating said cooled second gas phase into a first fraction primarily comprising ethane and a second fraction primarily comprising $C_{3+}$ hydrocarbons;

introducing into said first distillation column an overhead reflux comprising said first fraction and up to about five percent-by-weight of said residue gas;

introducing into said second distillation column said second fraction; and recovering from the bottom of said second distillation column substantially pure $C_{3+}$ hydrocarbons comprising at least about 94 percent-by-weight of the $C_{3+}$ hydrocarbons in said gas/condensate feed.

29. The process of claim 28 wherein said gas/condensate feed is cooled by countercurrent heat exchange with a refrigerant stream comprising a portion of said first liquid phase and resulting in partial vaporization of said refrigerant stream.

30. The process of claim 29 further comprising separating said partially vaporized refrigerant stream into a third liquid phase which is introduced into said second distillation column and a third gas phase which is introduced into said first distillation column as a stripping gas.

31. A process for the separation of $C_{3+}$ hydrocarbons from a hydrocarbon-containing gas feed under pressure, comprising:

introducing a cooled gas/condensate feed into a de-methanizer column at one or more feed trays;

separating said gas/condensate feed in said de-methanizer column into a first gas phase primarily comprising methane and ethane and into a first liquid phase primarily comprising $C_{2+}$ hydrocarbons;

introducing said first liquid phase into a de-ethanizer column at one or more feed trays;

separating said first liquid phase in said de-ethanizer column into a second gas phase primarily comprising ethane and a second liquid phase primarily comprising $C_{3+}$ hydrocarbons;

cooling said second gas phase by countercurrent heat exchange with a mixture comprising condensed liquid withdrawn from said de-methanizer column at a tray located below said feed trays and a portion of liquid separated from said gas/condensate feed before its introduction into said de-methanizer column;

separating said cooled second gas phase into a first gaseous fraction primarily comprising ethane and a second liquid fraction;

heating said first gas phase by countercurrent heat exchange with at least one of said first gaseous fraction and said gas feed and thereafter compressing said heated gas phase to produce a residue gas;

cooling and condensing said first gaseous fraction primarily comprising ethane;

introducing into said de-methanizer column as an overhead reflux said cooled and condensed first gaseous fraction primarily comprising ethane;

introducing into said de-ethanizer column said second liquid fraction; and recovering from the bottom of said de-ethanizer column said second liquid phase primarily comprising $C_{3+}$ hydrocarbons.

32. The process of claim 31 wherein up to about 5 percent-by-volume of said residue gas is included in said overhead reflux.

33. The process of claim 32 wherein the pressure of said 5 percent-by-volume of residue gas is substantially equal to the pressure of said first gaseous fraction.

34. The process of claim 31 further comprising including in said overhead reflux a sufficient volume of residue gas to prevent the formation of solids comprising ice, hydrates and mixtures thereof in said overhead reflux.

35. The process of claim 34 wherein up to about 10 percent-by-volume of said residue gas is included in said overhead reflux to prevent the formation of solids comprising ice, hydrates and mixtures thereof.

36. A process for the separation of $C_{3+}$ hydrocarbons from a hydrocarbon-containing gas feed under pressure, comprising:

introducing a cooled gas/condensate feed into a de-methanizer column at one or more feed trays;

separating said gas/condensate feed in said de-methanizer column into a first gas phase primarily comprising methane and ethane and into a first liquid phase primarily comprising $C_2$+ hydrocarbons;

using a portion of said first liquid phase as a refrigerant stream to cool said gas feed resulting in partial vaporization of said refrigerant stream;

introducing another portion of said first liquid phase into a de-ethanizer column at one or more feed trays;

separating said first liquid phase in said de-ethanizer column into a second gas phase primarily comprising ethane and a second liquid phase primarily comprising $C_{3+}$ hydrocarbons;

cooling said second gas phase by countercurrent heat exchange with a mixture comprising condensed liquid withdrawn from said de-methanizer column at a tray located below said feed trays and a portion of liquid separated from said gas/condensate feed before its introduction into said de-methanizer column;

separating said cooled second gas phase into a first gaseous fraction primarily comprising ethane and a second liquid fraction;

separating said partially vaporized refrigerant stream into a third liquid phase which is introduced into said de-ethanizer column and a third gas phase which is introduced into said de-methanizer column as a stripping gas;

cooling and condensing said first gaseous fraction primarily comprising ethane;

introducing into said de-methanizer column as an overhead reflux said cooled and condensed first gaseous fraction primarily comprising ethane;

introducing into said de-ethanizer column said second liquid fraction; and recovering from the bottom of said de-ethanizer column said second liquid phase primarily comprising $C_{3+}$ hydrocarbons.

37. The process of claim 36 wherein said refrigerant stream is drawn from one or more trays located below the first feed tray of said de-methanizer.

38. The process of claim 36 wherein said refrigerant stream is further cooled prior to supplying refrigeration for said feed gas.

39. The process of claim 36 wherein said third gas phase is partially condensed by compressing and cooling.

40. A process for the separation of $C_{3+}$ hydrocarbons from a hydrocarbon-containing gas feed under pressure, comprising:

introducing a cooled gas/condensate feed into a de-methanizer column at one or more feed trays;

separating said gas/condensate feed in said de-methanizer column into a first gas phase primarily comprising methane and ethane and into a first liquid phase primarily comprising $C_2$+ hydrocarbons;

introducing said first liquid phase into a de-ethanizer column at one or more feed trays;

separating said first liquid phase in said de-ethanizer column into a second gas phase primarily comprising ethane and a second liquid phase primarily comprising $C_3$+ hydrocarbons;

cooling said second gas phase by countercurrent heat exchange with a mixture comprising condensed liquid withdrawn from said de-methanizer column at a tray located below said feed trays and a portion of liquid separated from said gas/condensate feed before its introduction into said de-methanizer column;

introducing said heated mixture back into said de-methanizer column at a location below the tray from which said condensed liquid was withdrawn;

separating said cooled second gas phase into a first gaseous fraction primarily comprising ethane and a second liquid fraction;

cooling and condensing said first gaseous fraction primarily comprising ethane;

introducing into said de-methanizer column as an overhead reflux said cooled and condensed first gaseous fraction primarily comprising ethane;

introducing into said de-ethanizer column said second liquid fraction; and recovering from the bottom of said de-ethanizer column said second liquid phase primarily comprising $C_{3+}$ hydrocarbons.

41. A process for the separation of $C_{3+}$ hydrocarbons from a hydrocarbon-containing gas feed under pressure, comprising:

introducing a cooled gas/condensate feed into a first distillation column at one or more feed trays;

separating said gas/condensate feed in said first column into a first gas phase primarily comprising methane and ethane and into a first liquid phase primarily comprising $C_2$+ hydrocarbons;

introducing said first liquid phase into a second distillation column at one or more feed trays;

separating said first liquid phase in said second distillation column into a second gas phase primarily comprising ethane and a second liquid phase primarily comprising $C_3$+ hydrocarbons;

cooling and condensing said second gas phase primarily comprising ethane;

introducing into said first distillation column as an overhead reflux at least a portion of said cooled and condensed second gas phase primarily comprising ethane and up to about 5 percent-by-volume of a residue gas recovered from said first gas phase; and recovering from the bottom of said second distillation column said second liquid phase primarily comprising $C_{3+}$ hydrocarbons.

42. The process of claim 41 wherein the pressure of said 5 percent-by-volume of residue gas is substantially equal to the pressure of said second gas phase.

43. A process for the separation of $C_{3+}$ hydrocarbons from a hydrocarbon-containing gas feed under pressure, comprising:

introducing a cooled gas/condensate feed into a first distillation column at one or more feed trays;

separating said gas/condensate feed in said first column into a first gas phase primarily comprising methane and ethane and into a first liquid phase primarily comprising $C_2$+ hydrocarbons;

introducing said first liquid phase into a second distillation column at one or more feed trays;

separating said first liquid phase in said second distillation column into a second gas phase primarily comprising ethane and a second liquid phase primarily comprising $C_3$+ hydrocarbons;

cooling and condensing said second gas phase primarily comprising ethane;

introducing into said first distillation column as an overhead reflux at least a portion of said cooled and condensed second gas phase primarily comprising ethane and up to about 10 percent-by-volume of a residue gas recovered from said first gas phase to prevent the formation in said overhead reflux of solids comprising ice, hydrates and mixtures thereof; and recovering from the bottom of said second distillation column said second liquid phase primarily comprising $C_{3+}$ hydrocarbons.

44. A process for the separation of $C_{3+}$ hydrocarbons from a hydrocarbon-containing gas feed under pressure, comprising:

introducing a cooled gas/condensate feed into a first distillation column at one or more feed trays;

separating said gas/condensate feed in said first column into a first gas phase primarily comprising methane and ethane and into a first liquid phase primarily comprising $C_2$+ hydrocarbons;

using a portion of said first liquid phase as a refrigerant stream to cool said gas feed resulting in partial vaporization of said refrigerant stream;

introducing another portion of said first liquid phase into a second distillation column at one or more feed trays;

separating said first liquid phase in said second distillation column into a second gas phase primarily comprising ethane and a second liquid phase primarily comprising $C_3$+ hydrocarbons;

separating said partially vaporized refrigerant stream into a third liquid phase which is introduced into said second distillation column and a third gas phase which is introduced into said first distillation column as a stripping gas;

cooling and condensing said second gas phase primarily comprising ethane;

introducing into said first distillation column as an overhead reflux at least a portion of said cooled and condensed second gas phase primarily comprising ethane; and recovering from the bottom of said second distillation column said second liquid phase primarily comprising $C_{3+}$ hydrocarbons.

45. The process of claim 44 wherein said refrigerant stream is drawn from one or more trays below the first feed tray of said first column.

46. The process of claim 44 wherein said refrigerant stream is cooled prior to supplying refrigeration for said gas feed.

47. The process of claim 44 wherein said third gas phase is partially condensed by compressing and cooling.

* * * * *

UNITED STATES PATENT AND TRADEMARK OFFICE

CERTIFICATE OF CORRECTION

PATENT NO. : 6,116,050
APPLICATION NO. : 09/209931
DATED : September 12, 2000
INVENTOR(S) : James Yao et al.

It is certified that error appears in the above-identified patent and that said Letters Patent is hereby corrected as shown below:

At column 16, line 6, replace “13” with --1--.

At column 17, line 10, replace “24” with --23--.

Signed and Sealed this

Thirty-first Day of July, 2007

JON W. DUDAS
*Director of the United States Patent and Trademark Office*